US005837055A

United States Patent [19]

Yamada et al.

[11] Patent Number: 5,837,055

[45] Date of Patent: Nov. 17, 1998

[54] LEVITATION MELTING METHOD AND MELTING AND CASTING METHOD

[75] Inventors: Junji Yamada, Nagoya; Noboru Demukai, Kaizu-gun, both of Japan

[73] Assignee: Daido Tokushuko Kaisha, Aichi, Japan

[21] Appl. No.: 641,972

[22] Filed: May 1, 1996

[30] Foreign Application Priority Data

May 19, 1995 [JP] Japan ..... 7-145537
Jun. 29, 1995 [JP] Japan ..... 7-188205

[51] Int. Cl.[6] ..... C30B 11/02

[52] U.S. Cl. ..... 117/82; 117/901; 164/122.2; 164/493

[58] Field of Search ..... 117/82, 94; 164/493, 164/122.2

[56] References Cited

U.S. PATENT DOCUMENTS 4,373,571 2/1983 Yarwood et al. ..... 164/467
4,441,542 4/1984 Pryor et al. ..... 164/485
4,735,252 4/1988 Roberts ..... 164/46
5,003,551 3/1991 Mortimer ..... 373/139
5,014,769 5/1991 El-Kaddah et al. ..... 164/493
5,033,948 7/1991 El-Kaddah et al. ..... 425/8

FOREIGN PATENT DOCUMENTS

05/167147 1/1995 Japan .

*Primary Examiner*—Robert Kunemund
*Attorney, Agent, or Firm*—Koda & Androlia

[57] ABSTRACT

Disclosed is a levitation melting method comprising applying a high-frequency current to a high frequency induction coil wound around a melting crucible to induction-heat a material introduced to the melting crucible; and erecting the resulting molten metal to be in no contact with the inner wall surface of the melting crucible with the bottom of the material being maintained in the solidified state; wherein a power input P of a high-frequency power source to the high-frequency induction coil, an inner radius R at the bottom of the crucible and super heat ΔT of the molten metal satisfy the relationship of P/R2=ΔT·(0.0008 to 0.002), as well as, a melting and casting method for casting the molten metal prepared by the levitation melting method described above into a mold using a snout suspended above the melting crucible such that the lower end of the snout may be submerged in the molten metal.

7 Claims, 7 Drawing Sheets

FIG. 3

| | Example 1 | Example 2 | Example 3 | Example 4 | Example 5 | Example 6 |
|---|---|---|---|---|---|---|
| Kind of metal | Ti6Al4V | Ti6Al4V | TiAl | TiAl | SUS304 | SUS304 |
| Inner radius of crucible R (mm) | 45 | 60 | 60 | 80 | 60 | 80 |
| Power input P (kw) | 300 | 500 | 500 | 500 | 400 | 600 |
| Super heat $\Delta T$ (℃) | 105 | 99 | 86 | 48 | 93 | 81 |
| Power efficiency $\eta$ (—) | 0.25 | 0.28 | 0.29 | 0.30 | 0.27 | 0.29 |
| Shape constant $\alpha$ (—) | 6.0 | 5.9 | 6.1 | 5.8 | 5.8 | 5.4 |
| $\delta / \lambda$ ($mm^2$℃/kw) | $1.7 \times 10^4$ | $1.5 \times 10^4$ | $1.3 \times 10^4$ | $1.2 \times 10^4$ | $1.8 \times 10^4$ | $1.6 \times 10^4$ |
| Operation constant C (kw/$mm^2$℃) | 0.0014 | 0.0014 | 0.0016 | 0.0016 | 0.0012 | 0.0012 |

FIG. 4

| | Example 1 | Example 2 | Example 3 |
|---|---|---|---|
| Kind of metal | Ti6Al4V | Ti6Al4V | TiAl |
| Inner radius of crucible R (mm) | 45 | 80 | 45 |
| Power input P (kw) | 500 | 600 | 300 |
| Super heat Δ T(°C) Preestimated | 123～309 | 47～117 | 74～185 |
| Found | 145 | 85 | 105 |

FIG. 5

| Material \ Super heat ΔT | 10 | 15 | 20 | 25 | | 295 | 300 | 305 | 310 |
|---|---|---|---|---|---|---|---|---|---|
| Ti6Al4V | × | × | ○ | ○ | | ○ | △ | × | × |
| TiAl | × | × | ○ | ○ | | ○ | ○ | × | × |
| SUS304 | × | × | ○ | ○ | | ○ | ○ | × | × |

○ ; Neither misrun nor damage of the mold occurred

× ; Misrun occurred to give defective products, or the mold was damaged

△ ; The mold was slightly damaged

FIG. 7

| | Example 1 | Example 2 | Example 3 | Example 4 | Example 5 | Comp. Example 1 | Comp. Example 2 | Comp. Example 3 |
|---|---|---|---|---|---|---|---|---|
| Condition (1) | 1.0 | 1.5 | 0.6 | 1.5 | 0.6 | 0.4 | 1.8 | 1.5 |
| Condition (2) | 5 | 4 | 8 | 3 | 10 | 15 | 2 | 2 |
| Condition (3) | 10 | 10 | 10 | 5 | 5 | 10 | 10 | 5 |
| Condition (4) | 20 | 20 | 20 | 10 | 15 | 10 | 25 | 6 |
| Condition (5) | 0.3 | 0.3 | 0.4 | 0.5 | 0.3 | 0.3 | 0.4 | 0.7 |
| Super heat stability | ◎ | ◎ | ◎ | ○ | ○ | △ | × | ○ |
| Contact of molten metal (Present/Absent) | ○ | ○ | ○ | ○ | ○ | ○ | × | △ |
| Sucked gas (Present/Absent) | ○ | ○ | ○ | ○ | ○ | ○ | ○ | × |

◎: Excellent ○: Good or Absent △: Insufficient ×: Poor or Present

LEVITATION MELTING METHOD AND MELTING AND CASTING METHOD

BACKGROUND OF THE INVENTION

1. Field of the Invention

The present invention relates to a levitation (electromagnetic) melting method and also to a melting and casting method. More particularly, the present invention relates to a levitation melting method for subjecting a metallic material introduced to a melting crucible to induction heating and retaining the resulting molten metal in the melting crucible in no contact with the inner wall surface of the crucible and also to a melting and casting method for casting the molten metal obtained by the levitation melting method into a mold.

2. Description of the Related Art

There is known the levitation melting method as a melting method which can prevent, when a metallic material of various kinds introduced to a melting crucible is to be melted therein, the resulting molten metal from being contaminated due to chemical reactions occurring when it is brought into contact with the inner wall surface of the crucible and which can thus achieve improvement in the quality of molten metal. This levitation melting method includes a full-levitation melting method in which a molten metal is fully levitated by an electromagnetic force and a semi-levitation melting method in which a molten metal is erected by an electromagnetic force with the bottom of a material to be melted being maintained in the solidified state using a water-cooled copper crucible. In the full-levitation melting method, since the molten metal is fully levitated, migration of contaminants from the melting crucible can be fully prevented, but it is difficult to retain the molten metal in the levitated state. Further, since the full-levitation method cannot levitate a large amount of molten metal, the semi-levitation melting method is rather employed for industrial applications.

To describe briefly the semi-levitation method, the water-cooled copper crucible employable here has a cylindrical main body with a closed bottom. The circumferential wall of the main body is vertically divided into some sectorial segments through which a cooling water is circulated, and these segments are electrically insulated from one another by an insulating material. Further, annular high-frequency induction coils are disposed to surround the water-cooled crucible with predetermined annular spaces being secured between them, and when a material is introduced into the crucible and a high-frequency current is applied to the induction coils, the material is induction-heated. When the material is heated to a predetermined temperature, it is partly melted with the bottom thereof brought into contact with the inner bottom surface of the water-cooled copper crucible being maintained in the solidified state, and the molten metal is retained in the erected state in no contact with the inner wall surface of the crucible by the electromagnetic force penetrating the crucible.

In the semi-levitation melting method described above, the super heat (the melting point of the material is the standard temperature (0° C.)) of the molten metal retained in the erected state in no contact with the inner circumferential wall surface of the water-cooled copper crucible must be properly maintained. If the temperature of the molten metal is too low when it is poured into a mold, misrunning occurs to give defective products; whereas if it is too high, the mold itself is likely to be damaged.

Since the super heat of the molten metal varies depending on various conditions such as an input value of high frequency current to be applied to the induction coils from a high-frequency power source, the size of the water-cooled crucible, the kind of the material, etc., these conditions must be set adequately so as to perform the melting operation efficiently at a super heat suitable for casting the molten metal. Therefore, it has been difficult to preestimate the super heat in the stage of designing the melting equipments, including the water-cooled crucible and the induction coils so as to design the melting apparatus and also to set operational conditions, including the input value of high frequency current to be applied to the induction coils from a high-frequency power source. Specifically, under the present circumstances, optimum conditions have been found experimentally at a great cost of labor and time employing laboratory equipments by changing these conditions. Further, the most optimum super heat of the molten metal for casting has not yet been established.

Further, there has not been established conditions for the state of the molten metal (for maintaining the erected state) under which the molten metal can be maintained at an adequate super heat while it is retained stably in no contact with the inner wall surface of the crucible. In addition, while a contaminant-free molten metal prepared by the semi-levitation melting method must be poured as such into a mold in order to obtain a quality molded product, there has not been established conditions for efficiently carrying out the casting method and casting operations.

SUMMARY OF THE INVENTION

The present invention is proposed in view of the disadvantages inherent in the levitation melting method and in the melting and casting method described above and with a view to overcoming them successfully, and it is an objective of the present invention to provide a levitation melting method which enables not only designing of the melting equipments but also simplification of operational conditions by preestimating the super heat of a molten metal; which enables efficient casting operation while the molten metal is maintained at a super heat suitable for casting; which enables maintenance of the molten metal in a proper state in the melting crucible; and which enables casting of the molten metal efficiently.

In order to overcome the problems described above and to attain the intended objective of the present invention, the levitation melting method according to one aspect of the present invention comprises applying a high-frequency current to a high-frequency induction coil wound around a melting crucible to induction-heat a material introduced to the melting crucible; and erecting the resulting molten metal to be in no contact with the inner wall surface of the melting crucible with the bottom of the material being maintained in the solidified state; wherein a power input P of a high-frequency power source to the high-frequency induction coil, an inner radius R at the bottom of the crucible and super heat ΔT of the molten metal satisfy the following relationship:

$$P/R2=\Delta T\cdot(0.0008 \text{ to } 0.002).$$

In order to overcome the problems described above and to attain the intended objective of the present invention, the levitation melting method according to another aspect of the present invention comprises applying a high-frequency current to a high-frequency induction coil wound around a melting crucible to induction-heat a material introduced to the melting crucible; and erecting the resulting molten metal to be in no contact with the inner wall surface of the melting crucible with the bottom of the material being maintained in the solidified state; wherein the method is carried out such that the super heat ΔT of the molten metal may be maintained in the range of 20° to 300° C.

In order to overcome the problems described above and to attain the intended objective of the present invention, the levitation melting method according to another aspect of the present invention comprises applying a high-frequency current to a high-frequency induction coil wound around a melting crucible to induction-heat a material introduced to the melting crucible; and erecting the resulting molten metal to be in no contact with the inner wall surface of the melting crucible with the bottom of the material being maintained in the solidified state; wherein the method is carried out such that the center height H of the molten metal in the melting crucible and the inner diameter D of the melting crucible may satisfy the following relationship:

$$H/D>0.5.$$

In order to overcome the problems described above and to attain the intended objective of the present invention, the levitation melting method according to another aspect of the present invention comprises applying a high-frequency current to a high-frequency induction coil wound around a melting crucible to induction-heat a material introduced to the melting crucible; and erecting the resulting molten metal to be in no contact with the inner wall surface of the melting crucible with the bottom of the material being maintained in the solidified state; wherein the method is carried out such that a clearance S of 3 to 10 mm may be secured between the inner wall surface of the crucible and the outer surface of the molten metal at the half height H/2 thereof.

In order to overcome the problems described above and to attain the intended objective of the present invention, the melting and casting method according to one aspect of the present invention comprises applying a high-frequency current to a high-frequency induction coil wound around a melting crucible to induction-heat a material introduced to the melting crucible; erecting the resulting molten metal to be in no contact with the inner wall surface of the melting crucible with the bottom of the material being maintained in the solidified state; and pouring the molten metal into a mold; wherein melting is carried out such that the center height H of the molten metal in the melting crucible and the inner diameter D of the melting crucible may satisfy the relationship of H/D>0.5; whereas pouring of the molten metal is carried out using a snout suspended above the melting crucible such that the lower end thereof may be submerged in the molten metal.

In order to overcome the problems described above and to attain the intended objective of the present invention, the melting and casting method according to another aspect of the present invention comprises applying a high-frequency current to a high-frequency induction coil wound around a melting crucible to induction-heat a material introduced to the melting crucible; erecting the resulting molten metal to be in no contact with the inner wall surface of the melting crucible with the bottom of the material being maintained in the solidified state; and pouring the molten metal into a mold; wherein melting is carried out such that a clearance S of 3 to 10 mm may be secured between the inner wall surface of the crucible and the outer surface of the molten metal at the half height H/2 thereof; whereas pouring of the molten metal into the mold is carried out using a snout suspended above the melting crucible such that the lower end thereof may be submerged in the molten metal.

BRIEF DESCRIPTION OF THE DRAWINGS

The features of the present invention that are believed to be novel are set forth with particularity in the appended claims. The invention, together with the objects and advantages thereof, may best be understood by reference to the following description of the presently preferred embodiments taken in conjunction with the accompanying drawings in which:

FIG. 3 is a table of various numerical values experimentally determined under various operational conditions;

FIG. 4 is a table of super heat temperature values ΔT preestimated under an operation constant C=0.0008 to 0.002 and the experimentally found super heat temperature values ΔT;

FIG. 5 is a table showing results of estimation for molded products obtained by using molten metals prepared in the melting apparatus and by casting them into molds by means of vacuum suction molding and the like, as well as, the molds;

FIG. 7 is a table showing results of tests made for Examples 1 to 5 satisfying the conditions (1) to (5) (to be described later) and for Comparative Examples 1 to 3 not satisfying one of the conditions (1) to (5).

DETAILED DESCRIPTION OF THE PREFERRED EMBODIMENT

The levitation melting method and the melting and casting method according to the present invention will be described below by way of preferred embodiments referring to the attached drawings. It should be noted that the term "inner bottom radius of a crucible (furnace radius)" used in the following description should not be understood to be limited to that of a circular cross section in the bottom of the crucible but should be appreciated to include imaginary radii in cross sections other than circle.

Figure 1:
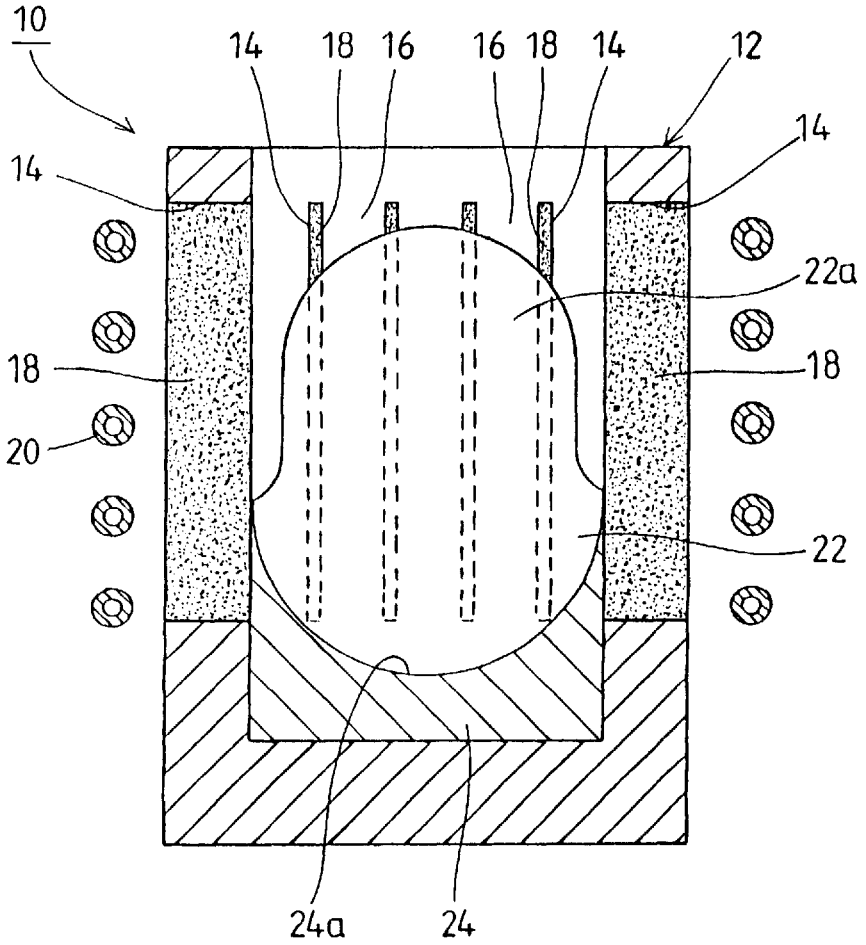
FIG. 1 is a schematic constitutional view of a melting apparatus in which the levitation melting method according to the present invention can be suitably embodied.

FIG. 1 is a schematic constitutional view of the melting apparatus in which the levitation melting method according to the present invention is embodied. A melting crucible 12 constituting the melting apparatus 10, which is made of copper, has a cylindrical form with a closed bottom, and a plurality of slits 14 are defined vertically at predetermined intervals in the circumferential direction of the crucible 12. Each slit 14 opens inward and outward in the radial direction of the melting crucible 12 and has a predetermined length in the axial direction of the crucible 12. Specifically, the circumferential wall of the crucible 12 consists of several segments 16 vertically divided by the slits 14. Further, each slit 14 is filled with an insulating material 18 such as a refractory ceramic, and thus each segment 16 is electrically insulated from the other segments 16.

A passage (not shown) through which a cooling water is circulated is defined in each segment 16 parallel to the slits 14 so that the melting crucible 12 may be cooled by the cooling water circulating through the passages. Meanwhile, annular high-frequency induction coils 20 are arranged at predetermined annular spaces between them so as to surround the melting crucible 12, and a material 22 placed in the crucible 12 is adapted to be heated by the heat induced when a high-frequency electric current is applied to the induction coils 20. It should be noted here that a solidifying shell 24 having a concave upper surface is provided at the inner bottom of the melting crucible 12 so that the material 22 may be placed on the concaved bottom section 24*a*. Thus, the material 22 placed at the bottom section 24*a* of the solidifying shell 24 is melted, when the crucible 12 is induction-heated, with the bottom thereof brought into contact with the shell 24 being maintained in the solidified state, and the thus obtained molten metal 22*a* is adapted to be erected to be in no contact with the inner wall surface of the crucible 12 under the electromagnetic force penetrating the crucible 12.

By the way, since the levitation melting method can generally heat the material 22 to a high temperature, it is suitable for melting active metals having high melting points such as titanium. Accordingly, extremely high heat is inconveniently dissipated from the molten metal prepared by the full-levitation melting method described above, because heat loss occurs by radiation only. On the other hand, the heat to be dissipated from the molten metal 22*a* obtained by the semi-levitation melting method according to the present embodiment includes radiant heat loss and conduction heat loss through the bottom section 24*a*. Therefore, the temperature of the molten metal 22*a* can be set at a level lower than in the full-levitation melting method.

(First levitation melting method)

Figure 2:
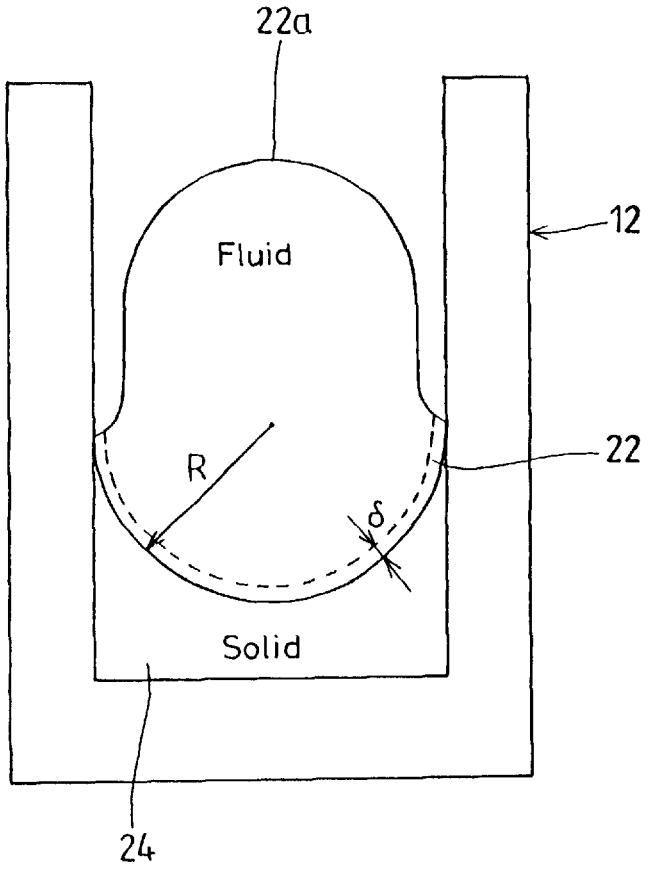
FIG. 2 is an explanatory view of a heat flow model showing how super heat of a molten metal is equilibrated in the levitation melting method.

According to the semi-levitation melting method embodied in the melting apparatus 10 having the constitution described above, the super heat of the molten metal 22*a* formed in the melting crucible 12 is rapidly equilibrated. A heat flow model showing such equilibrated state is illustrated in FIG. 2. The following equation is established in this model:

$$P\cdot\eta=(\Delta T\delta)\cdot\lambda\cdot(\alpha\cdot R2) \qquad \text{Equation 1}$$

P: power input (kw)

η: efficiency of power input to molten metal (–)

ΔT: super heat (°C.)

δ: thickness of the fluid side boundary layer at the solidifying interface at the bottom of the molten metal (mm)

λ: heat conductivity of the molten metal assuming a static state (kw/mm°C.)

α: shape constant of the heat dissipating surface at the solidifying interface of the material at the bottom of the melting crucible (bottom section 24*a*) (–)

R: Inner radius of the melting crucible (radius of the bottom section 24*a*) (mm)

The left-hand in the above equation represents an energy input to the molten metal 22*a;* whereas the right-hand represents an outflow energy. The first term (ΔT/δ) in the right-hand represents the temperature gradient in the fluid side boundary layer at the solidifying interface at the bottom section 24*a,* and the third term (α·R2) represents the heat dissipating area.

The super heat ΔT can be expressed using Equation 1 as follows:

$$\Delta T=(P/R2)\cdot\eta\cdot(\delta/\lambda)\cdot(1/\alpha) \qquad \text{Equation 2}$$

Thus, the super heat ΔT can be preestimated by employing Equation 2 and by determining the generally unknown numerical values η, δ, λ, α according to some methods and can be controlled.

For example, the power input efficiency η can be obtained by subjecting, in place of the molten metal 22*a,* a work which has a water-cooled structure and also has a similar electric conductivity and a similar shape to the molten metal 22*a* to induction heating in a crucible and by measuring the heat taken away from it by the cooling water circulated to the work. Meanwhile, the shape constant of the heat dissipation surface α can be determined by solidifying the molten metal 22*a* in the crucible, examining the solidified block and measuring the shape of the interface. For example, when the interface shape is a flat circle, α assumes the minimum value π; whereas when it is hemispherical, α assumes a value 2 π. In many cases, although it is difficult to directly measure the boundary layer thickness δ and to know a correct heat conductivity value λ of the molten metal 22*a* assuming the molten state, these values are considered to be constant if the molten metal 22*a* is of a fixed material. Accordingly, based on the known experimental data, these values can be obtained in terms of δ/λ (see FIG. 3).

The range of operation constant C can be determined by modifying Equation 2 into Equation 3 to incorporate the concept of operation constant C to it and by measuring the values η, δ, λ, α by experiments and the like.

$$\begin{aligned} P/R2 &= \Delta T\cdot(\lambda/\delta)\cdot(1/\eta)\cdot\alpha \\ &= \Delta T\cdot C \end{aligned} \qquad \text{Equation 3}$$

Accordingly, designing of the melting apparatus 10 and setting of operational conditions become possible by incorporating a constant C representative of various operational conditions when the super heat temperature ΔT is set in a temperature range suitable for casting.

The values R,P, ΔT, η, α, δ/λ,C were experimentally determined under various conditions, and the results are summarized in FIG. 3. It was found from the test results shown in FIG. 3 that operation constants C of common metals concentrate to a certain range, so that if the operation constant C is set between 0.0008 and 0.002, it is quite possible to substantially control the super heat ΔT of the molten metal 22*a*.

Super heat values ΔT preestimated provided that the operation constant C is between 0.0008 and 0.002 and experimentally found super heat values ΔT are shown in FIG. 4. The test data shown in FIG. 4 demonstrated that the found super heat values ΔT are all included within the preestimated ranges respectively.

More specifically, if the operation constant C is set between 0.0008 and 0.002 in Equation 3, the inner radius R (mm) of the crucible, power input P (kw) and super heat ΔT (°C.) can be set, thus enabling designing of an optimum melting apparatus 10 based on the conditions preestimated according to Equation 3 and also setting of efficient operational conditions.

(Second levitation melting method)

Next, various materials Ti-6Al-4V, TiAl and SUS304 were melted using the melting apparatus 10 at different super heat temperature levels ΔT, and the resulting molten metals were poured into molds to be molded by means of vacuum suction casting method and the like, followed by estimation of the resulting molded products and the molds. The results are summarized in FIG. 5.

As the results of FIG. 5 show, it was confirmed that, when the super heat ΔT of the molten metal is set lower than 20° C., the resulting products are defective due to misrunning; whereas when the super heat ΔT is set higher than 300° C., the molds are damaged by the high heat. In other words, it was found that the casting operations can be performed smoothly by maintaining the super heat ΔT of the molten metal between 20° C. and 300° C.

(Third levitation melting method)

Figure 6:
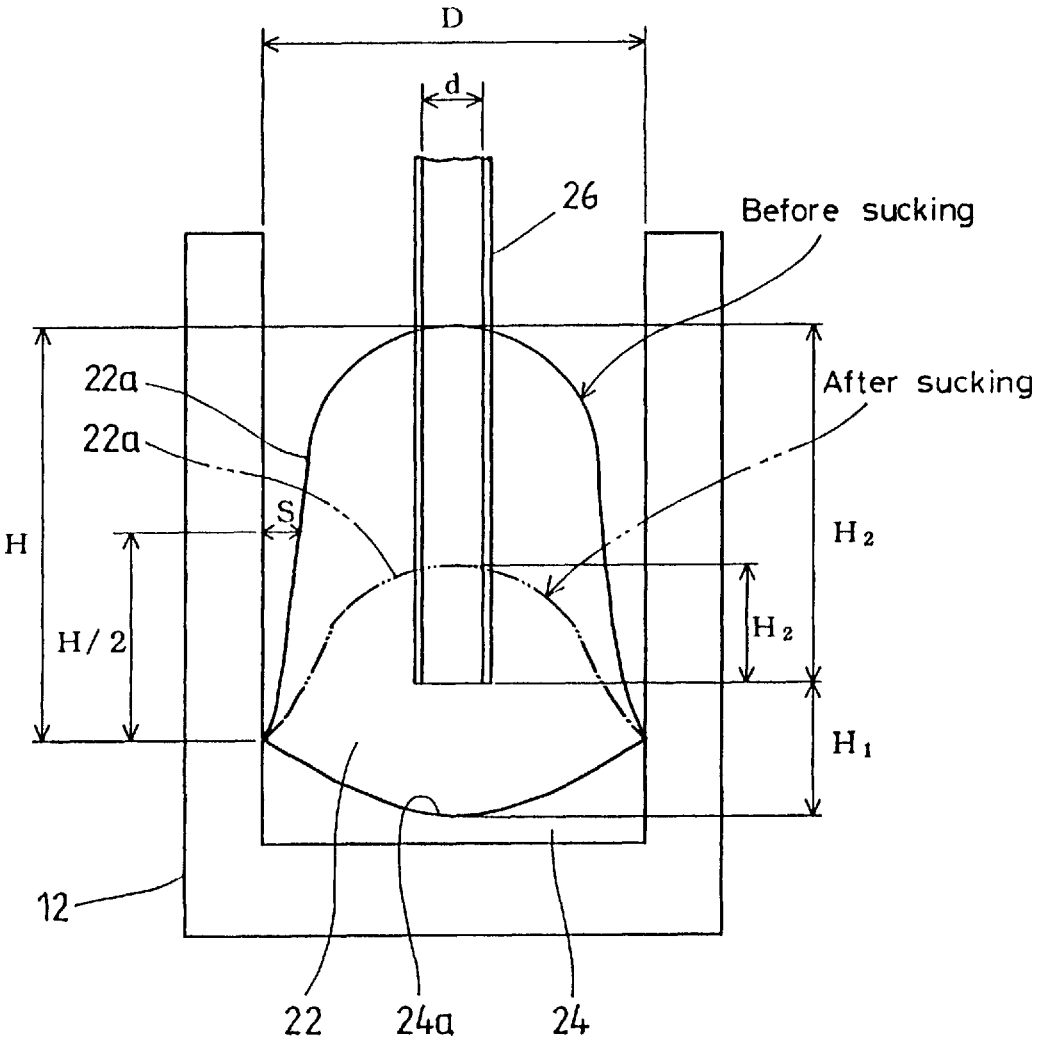
FIG. 6 is an explanatory view of the melting and casting method according to the present invention.

In the semi-levitation melting method to be embodied employing the melting apparatus 10 having the constitution as described above, the super heat of the molten metal 22*a* can be maintained at a level suitable for casting while the molten metal 22*a* formed in the melting crucible 12 is retained stably in no contact with the inner wall surface of the crucible 12, provided that (1) a relationship H/D>0.5 is established between the center height H of the molten metal 22*a* and the inner diameter D of the melting crucible 12. Incidentally, the center height H of the molten metal 22*a* is measured from the lower edge of the molten metal 22*a* from where it erects, as shown in FIG. 6. Specifically, since the center height H of the molten metal 22*a* in the melting crucible 12 is small and the top of the molten metal 22*a* is close to the bottom section 24*a* if H/D is 0.5 or less, the molten metal 22*a* cannot be heated sufficiently to the super heat ΔT, in some cases, due to heat conduction loss through the bottom section 24*a*. In addition, since the molten metal 22*a* assumes a thin flat shape, it sometimes becomes extremely difficult to put a snout 26 (to be described later) into it when it is cast, disadvantageously. Meanwhile, when H/D is set greater than 0.5, the top of the molten metal 22*a* is sufficiently spaced from the bottom section 24*a,* so that the super heat ΔT can be prevented from lowering due to heat conduction loss through the bottom section 24*a*. Besides, since the center height H of the molten metal 22*a* is regulated relative to the inner diameter D of the melting crucible 12, the erected molten metal 22*a* can be also prevented from being brought into contact with the inner wall surface of the crucible 12.

(Fourth levitation melting method)

In the semi-levitation melting method embodied employing the melting apparatus 10 having the constitution described above, melting operation is carried out (2) with the clearance S of 3 to 10 mm being secured between the inner wall surface of the crucible 12 and the outer surface of the molten metal 22*a* at the half height H/2 thereof. Thus, the super heat ΔT of the molten metal 22*a* formed in the melting crucible 12 can be maintained at a level suitable for casting while the molten metal 22*a* is stably retained in no contact with the inner wall surface thereof. Namely, if the clearance S is too small, the molten metal 22*a* wavers to readily touch the inner wall surface of the crucible 12. Accordingly, the minimum width of the clearance S is restricted to 3 mm so as to surely avoid contact of the wavering molten metal 22*a* with the inner wall surface of the crucible 12 and deterioration of the molten metal 22*a*. Meanwhile, if the clearance S is too great, the top of the molten metal 22*a* is tapered to readily waver, and thus the molten metal 22*a* becomes unstable. In addition, heating efficiency of the high-frequency induction coils 20 becomes too low to maintain the super heat ΔT at a proper level. In order to cope with this, the maximum width of the clearance S is restricted to 10 mm, so that the molten metal 22*a* can be stabilized and the super heat ΔT can be maintained at a level suitable for casting.

(First melting and casting method)

In a first melting and casting method, when a molten metal 22*a* prepared according to the third levitation melding method described above is poured into a mold (not shown), for example, a snout 26 communicating to the mold is suspended above the melting crucible 12 such that the lower end portion of the snout 26 may be submerged in the molten metal 22*a* with a closed vessel containing the mold being maintained under reduced pressure (see FIG. 6). Thus, the contaminant-free molten metal 22*a* in the crucible 12 is as such sucked into the mold through the snout 26 without being brought into contact with the inner wall surface of the crucible 12.

In this case, the casting operation can be performed stably and efficiently under the following conditions, and besides the accuracy of molded products can be improved.

(3) The height H1 of the lower end of the snout 26 submerged in the molten metal 22*a* is at least 5 mm as measured from the bottom section 24*a* of the melting crucible 12.

(4) The length H2 of the submerged portion of the snout 26 in the molten metal 22*a* is maintained at least to 10 mm.

(5) A relationship of d/D≦ is established between the inner diameter d of the snout 26 and the inner diameter D of the melting crucible 12.

If the requirement (3) is satisfied, the lower end of the snout 26 is prevented from contacting with the bottom section 24*a* of the melting crucible so as not to damage the snout 26 or the bottom section 24*a,* and the molten metal 22*a* can be sucked through the snout 26 smoothly. Meanwhile, if the requirement (4) is satisfied, since the lower end of the snout 26 is prevented from being exposed out of the molten metal 22*a* when the molten metal 22*a* is sucked through the snout 26 to have a low storage level, and thus sucking of a gas through the snout 26 to form defective molded products can be avoided. Further, if the requirement (5) is satisfied, since the inner diameter of the snout 26 is small relative to the molten metal 22*a* maintained in the erected state to have a hemispherical upper surface, the lower end of the snout 26 is prevented from being exposed out of the molten metal 22*a,* even when the snout 26 is shifted radially due to its displacement.

(Second melting and casting method)

In the second melting and casting method, the molten metal 22*a* prepared according to the fourth levitation melting method described above is poured into a mold through a snout 26 suspended above the melting crucible 12 such that the lower end of the snout 26 may be submerged in the molten metal 22*a*. In this case, if the requirements (3),(4) and (5) are satisfied, the contaminant-free molten metal 22*a* in the crucible 12 can be again poured as such into a mold, and thus not only casting operation can be performed stably but also the accuracy of molded products can be improved.

As the method of casting the molten metal 22*a* in the melting crucible 12 through the snout 26 into the mold in the first and second melting and casting methods, the vacuum casting method may be employed in place of the vacuum suction casting method, or an inert gas may be blown into the crucible 12 to increase the internal pressure thereof relative to that of the mold (reduced pressure or vacuum) and to pressurize the molten metal 22 to be fed into the snout 26.

(Test Examples)

Tests were carried out for Examples 1 to 5 all satisfying the requirements (1) to (5) described above and Comparative Examples 1 to 3 which do not satisfy any of these five requirements, respectively. The test results are shown in FIG. 7.

The test results of FIG. 7 show that, in the cases where the requirements (1) to (5) are all satisfied, stability of super heat, presence of contact of the molten metal 22*a* with the inner wall surface of the crucible 12, and presence of sucked gas were all evaluated as excellent or good (absent). On the other hand, in the cases where any of these requirements are not satisfied, these items were evaluated as inadequate or unacceptable present).

Only some embodiments of the present invention have been described herein, it should be apparent to those skilled in the art that the present invention may be embodied in many other specific forms without departing from the spirit or scope of the invention. Therefore, the present examples and embodiments are to be considered as illustrative and not restrictive, and the invention is not to be limited to the details given herein, but may be modified within the scope of the appended claims.

What is claimed is:

1. A levitation melting method comprising:

applying a high-frequency current to a high-frequency induction coil wound around a melting crucible to induction-heat a material introduced to said melting crucible; and erecting the resulting molten metal to be in no contact with the inner wall surface of said melting crucible with the bottom of said material being maintained in the solidified state; and wherein:

a power input P of a high-frequency power source to said high-frequency induction coil, an inner radius R at the bottom of said crucible and super heat ΔT of said molten metal satisfy the following relationship:

$P/R^2=\Delta T\cdot(0.0008 \text{ to } 0.002)$; and said method is carried out such that the super heat ΔT of said molten metal may be maintained in the range of 20° to 300° C.

2. A levitation melting method comprising:

applying a high-frequency current to a high-frequency induction coil wound around a melting crucible to induction-heat a material introduced to said melting crucible; and erecting the resulting molten metal to be in no contact with the inner wall surface of said melting crucible with the bottom of said material being maintained in the solidified state; and wherein:

said method is carried out such that a center height H of said molten metal in said melting crucible and an inner diameter D of said melting crucible satisfies the following relationship:

$H/D>0.5$; and said method is carried out such that a super heat ΔT of said molten metal may be maintained in the range of 20° to 300° C.

3. A levitation melting method according to claim 2, wherein said method is carried out such that a clearance S of 3 to 10 mm may be secured between an inner wall surface of said crucible and an outer surface of said molten metal at the half height H/2 thereof.

4. A melting and casting method comprising:

applying a high-frequency current to a high-frequency induction coil wound around a melting crucible to induction-heat a material introduced to said melting crucible;

erecting the resulting molten metal to be in no contact with the inner wall surface of said melting crucible with the bottom of said material being maintained in the solidified state; and pouring said molten metal into a mold; and wherein:

melting is carried out such that a center height H of said molten metal in said melting crucible and an inner diameter D of said melting crucible satisfies the relationship of $H/D>0.5$;

pouring of said molten metal is carried out using a snout suspended above said melting crucible such that a lower end thereof is submerged in said molten metal; and said method is carried out such that a super heat ΔT of said molten metal is maintained in the range of 20° to 300° C.

5. A melting and casting method according to claim 4, wherein melting is carried out such that a clearance S of 3 to 10 mm may be secured between an inner wall surface of said crucible and an outer surface of said molten metal at a half height H/2 thereof.

6. The melting and casting method according to claims 4 or 5, wherein a height H1 of a lower end of said snout submerged in said molten metal is at least 5 mm as measured from an inner bottom section of said melting crucible, a length H2 of the submerged portion of said snout in said molten metal is maintained at least to 10 mm and the inner diameter d of said snout to be submerged in said molten metal is adapted to be ½ as much as or less than the inner diameter D of said melting crucible.

7. A melting and casting method according to claims 3 or 4 wherein an inner diameter d of said snout submerged in said molten metal is adapted to be ½ as much as or less than an inner diameter D of said melting crucible, a height H1 of a lower end of said snout submerged in said molten metal is at least 5 mm as measured from an inner bottom section of said melting crucible, and a length H2 of a submerged portion of said snout in said molten metal is maintained to at least 10 mm.

* * * * *

UNITED STATES PATENT AND TRADEMARK OFFICE

CERTIFICATE OF CORRECTION

PATENT NO. : 5,837,055

DATED : November 17, 1998

INVENTOR(S) : Junji Yamada, et al.

It is certified that error appears in the above-indentified patent and that said Letters Patent is hereby corrected as shown below:

On the title page,

Item [73] Assignee: Change "Daido Tokushuko Kaisha, Aichi, Japan," to --Daido Tokushuko Kabushiki Kaisha, Aichi, Japan--

Signed and Sealed this

Twenty-seventh Day of April, 1999

*Attest:*

*Attesting Officer*

Q. TODD DICKINSON

*Acting Commissioner of Patents and Trademarks*